US011154970B2

(12) United States Patent
Li et al.

(10) Patent No.: US 11,154,970 B2
(45) Date of Patent: Oct. 26, 2021

(54) NAIL SUPPLY DEVICE FOR PNEUMATIC NAIL GUN

(71) Applicants: Xiaorong Li, Zhejiang (CN); Fazheng Yang, Zhejiang (CN)

(72) Inventors: Xiaorong Li, Zhejiang (CN); Fazheng Yang, Zhejiang (CN)

(73) Assignee: Zhejiang Rongpeng Air Tools Co., Ltd., Zhejiang (CN)

( * ) Notice: Subject to any disclaimer, the term of this patent is extended or adjusted under 35 U.S.C. 154(b) by 258 days.

(21) Appl. No.: 16/395,195

(22) Filed: Apr. 25, 2019

(65) Prior Publication Data

US 2020/0338707 A1 Oct. 29, 2020

(51) Int. Cl.
*B25C 1/00* (2006.01)
*B25C 1/04* (2006.01)

(52) U.S. Cl.
CPC ..... *B25C 1/001* (2013.01); *B25C 1/047* (2013.01)

(58) Field of Classification Search
CPC ..... B25C 1/001; B25C 1/005; B25C 1/04; B25C 1/047; B25C 7/00
USPC ..... 81/430; 227/112, 114–118, 135, 136
See application file for complete search history.

(56) References Cited

U.S. PATENT DOCUMENTS 3,261,526 A * 7/1966 Novak ..... B25C 1/041 227/1
3,275,191 A * 9/1966 MacDonald ..... B25B 23/04 221/175
3,448,236 A * 6/1969 Spisak ..... B23K 9/206 219/98
3,487,190 A * 12/1969 Glorioso ..... B23K 11/0053 219/98
3,708,097 A * 1/1973 Fisher ..... B25C 1/003 227/136
3,854,648 A * 12/1974 Inzoli ..... B25C 1/003 227/136
3,900,131 A * 8/1975 Ehrlich ..... B25B 23/04 221/169
4,278,184 A * 7/1981 Willis ..... B25B 23/04 221/233
4,389,012 A * 6/1983 Grikis ..... B25C 1/005 221/198
4,775,089 A * 10/1988 MacDonald ..... B25C 1/00 227/116

(Continued)

FOREIGN PATENT DOCUMENTS

FR 351190 A * 7/1905 ..... B25C 7/00

*Primary Examiner* — Joshua G Kotis

(57) ABSTRACT

A nail supply device for pneumatic nail gun, including a piston seat, a longitudinal slideway, a transverse slideway connected to the longitudinal slideway, nail guide plates, and a slide clearance; the lower surface of the piston seat having a nail output interface; the upper surface of the piston seat having a nail inlet hole vertically connected to the nail output interface, the front side of nail inlet hole is connected to the rear side of longitudinal slideway; the front sidewall of the piston seat having a piston hole and a nail push hole adjacent to the piston hole, the nail push hole is connected to the longitudinal slideway. The nail supply device for pneumatic nail gun of the present invention can supply nails automatically when the pneumatic nail gun is nailing, the nailing efficiency and nailing quality are guaranteed effectively.

7 Claims, 7 Drawing Sheets

(56) References Cited

U.S. PATENT DOCUMENTS 5,004,141 A * 4/1991 Young ..... B23P 19/003
227/112
5,014,876 A * 5/1991 Young ..... B23P 19/003
221/233
5,199,506 A * 4/1993 Dewey ..... B25C 1/001
173/104
5,480,087 A * 1/1996 Young ..... B23P 19/003
221/268

* cited by examiner

NAIL SUPPLY DEVICE FOR PNEUMATIC NAIL GUN

BACKGROUND OF INVENTION

1. Field of the Invention

The present invention relates generally to a nail supply device for pneumatic nail gun.

2. Description of Related Art

The pneumatic nail gun is a pneumatic tool using air pressure for nailing. Generally, before the pneumatic nail gun is used, its charger is loaded with nails manually. When the nails in the charger are used up, the charger shall be loaded with nails again by the nailer. The charger capacity of pneumatic nail gun is limited, the nails shall be loaded once the charger is empty, and the nailing process is always long, the repeated nail loading has a strong impact on the nailing efficiency, and so much nail loading severely increases the nailer's workload, the nailer is likely to feel tired, so that the nailing quality cannot be guaranteed.

SUMMARY OF THE INVENTION

The purpose of the present invention is to overcome the deficiencies in the existing technology to provide a nail supply device for pneumatic nail gun.

In order to solve the above problems, the technical scheme of the present invention is described below:

A nail supply device for pneumatic nail gun, comprising a piston seat, wherein an upper surface of the piston seat is provided with a longitudinal slideway; a right sidewall of the piston seat is provided with a transverse slideway connected to the longitudinal slideway; both sides of inner walls of the longitudinal slideway and transverse slideway are provided with nail guide plates, the opposite nail guide plates are arranged in funnel shape, there is a slide clearance between opposite nail guide plates; the lower surface of the piston seat is provided with a nail output interface; the upper surface of the piston seat is provided with a nail inlet hole vertically connected to the nail output interface, the front side of nail inlet hole is connected to the rear side of longitudinal slideway; the front sidewall of the piston seat is provided with a piston hole and a nail push hole adjacent to the piston hole, the nail push hole is connected to the longitudinal slideway; a matched nail push block is located in the nail push hole; the nail push block is opposite to the slide clearance in the longitudinal slideway, the width of nail push block is smaller than the width of slide clearance; the rear sidewall of the piston seat is provided with a spacing hole connected to the piston hole; the front orifice of the piston hole is provided with a piston cover; a matched piston is located in the piston hole; the front end of the piston is provided with a front piston rod matching the piston cover, the back end of piston is provided with a back piston rod matching the spacing hole; the front piston rod is extended through the piston cover and connected to the nail push block; the upper and lower parts of the inner wall on the left of the junction of the longitudinal slideway and transverse slideway are provided with an upper magnet and a lower magnet respectively; the forward-backward reciprocating action of the piston is implemented by a first air delivery device and a second air delivery device.

More particularly, wherein the first air delivery device has a first air passage located in the piston seat; one end port of the first air passage is located in the back end inner wall of piston hole, the other end port is connected to a first air passage interface; the second air delivery device has a second air passage located in the piston seat; one end port of the second air passage is located in the front end inner wall of piston hole, the other end port is connected to a second air passage interface; the piston is located between the port of the first air passage in the inner wall of piston hole and the port of the second air passage in the inner wall of piston hole.

More particularly, wherein an inner wall of the spacing hole, the outer wall of piston, the outer wall of front piston rod and one sidewall of piston cover opposite to the right orifice of piston hole are provided with several seal grooves; there are matched seal rings in the seal grooves.

More particularly, wherein an end of the nail push block includes an orthogonal link block extended therefrom; the link block is connected to the end of front piston rod by an axle pin.

More particularly, wherein the upper surface of the piston seat is provided with a plurality of fixing screw holes.

More particularly, wherein the piston seat includes a chucking step disposed on the right side of the upper end thereof.

More particularly, wherein the piston seat includes an upper mounting slot the left sidewall of and a lower mounting slot located normally disposed under the upper mounting slot, the upper magnet is installed in the upper mounting slot, and the lower magnet is installed in the lower mounting slot; the upper mounting slot and lower mounting slot are connected to the longitudinal slideway by a clearance hole.

The technical problem to be solved by the present invention is to provide a nail supply device for pneumatic nail gun, which can automatically supply nails to the pneumatic nail gun during nailing, the nailing efficiency and nailing quality are guaranteed effectively.

Effects of the Present Invention

The nail supply device for pneumatic nail gun of the present invention can receive the nails from the vibrating tray continuously, it supplies nails to the pneumatic nail gun in each operation, so that the charger of pneumatic nail gun always has sufficient nails, the manual loading process is reduced, the workload is reduced and the nailing efficiency is increased effectively, and the nailer can concentrate on nailing, the nailing quality is guaranteed effectively.

DETAILED DESCRIPTION OF THE INVENTION

Figure 1:
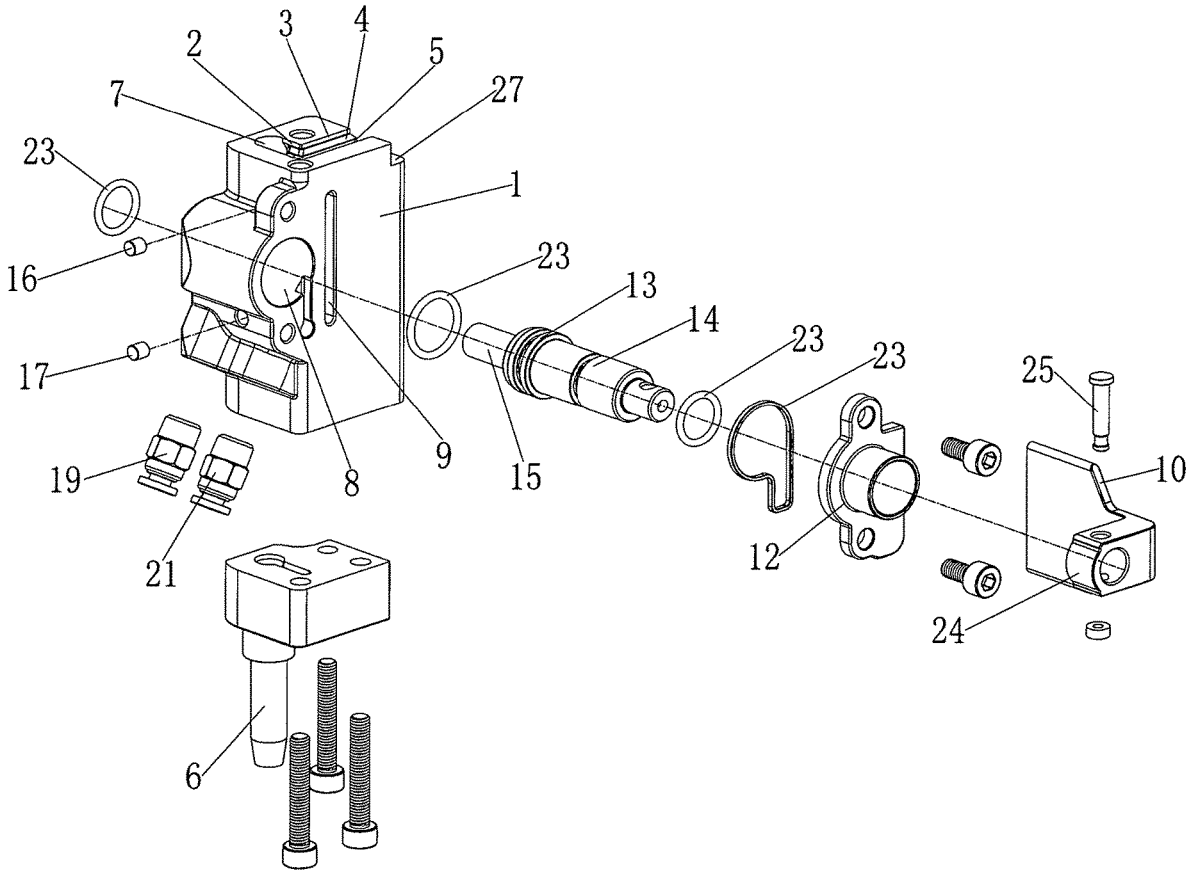
FIG. 1 is a structural representation of the nail supply device for pneumatic nail gun of the present invention.
Figure 2:
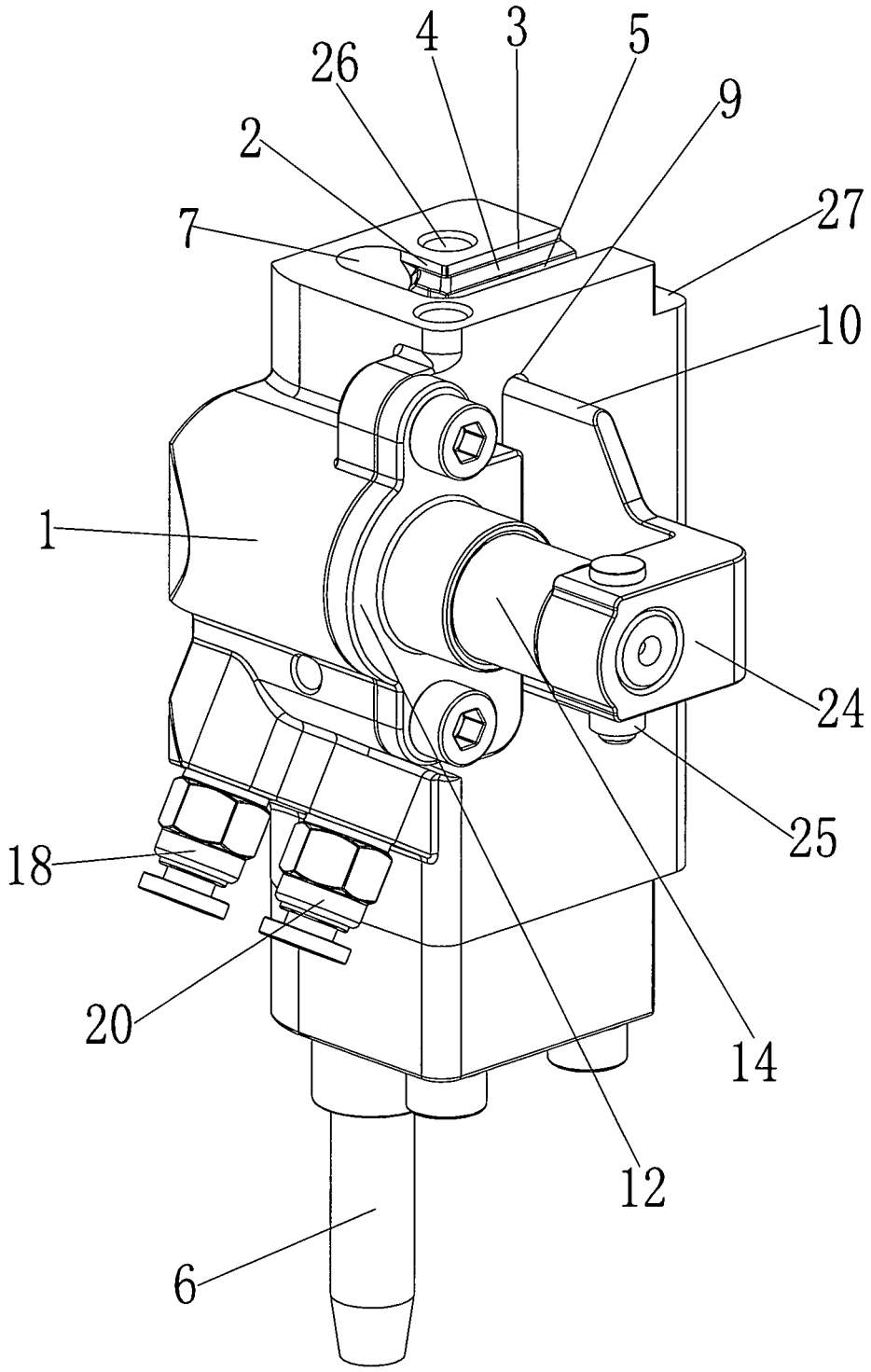
FIG. 2 is a stereogram of the nail supply device for pneumatic nail gun of the present invention.
Figure 3:
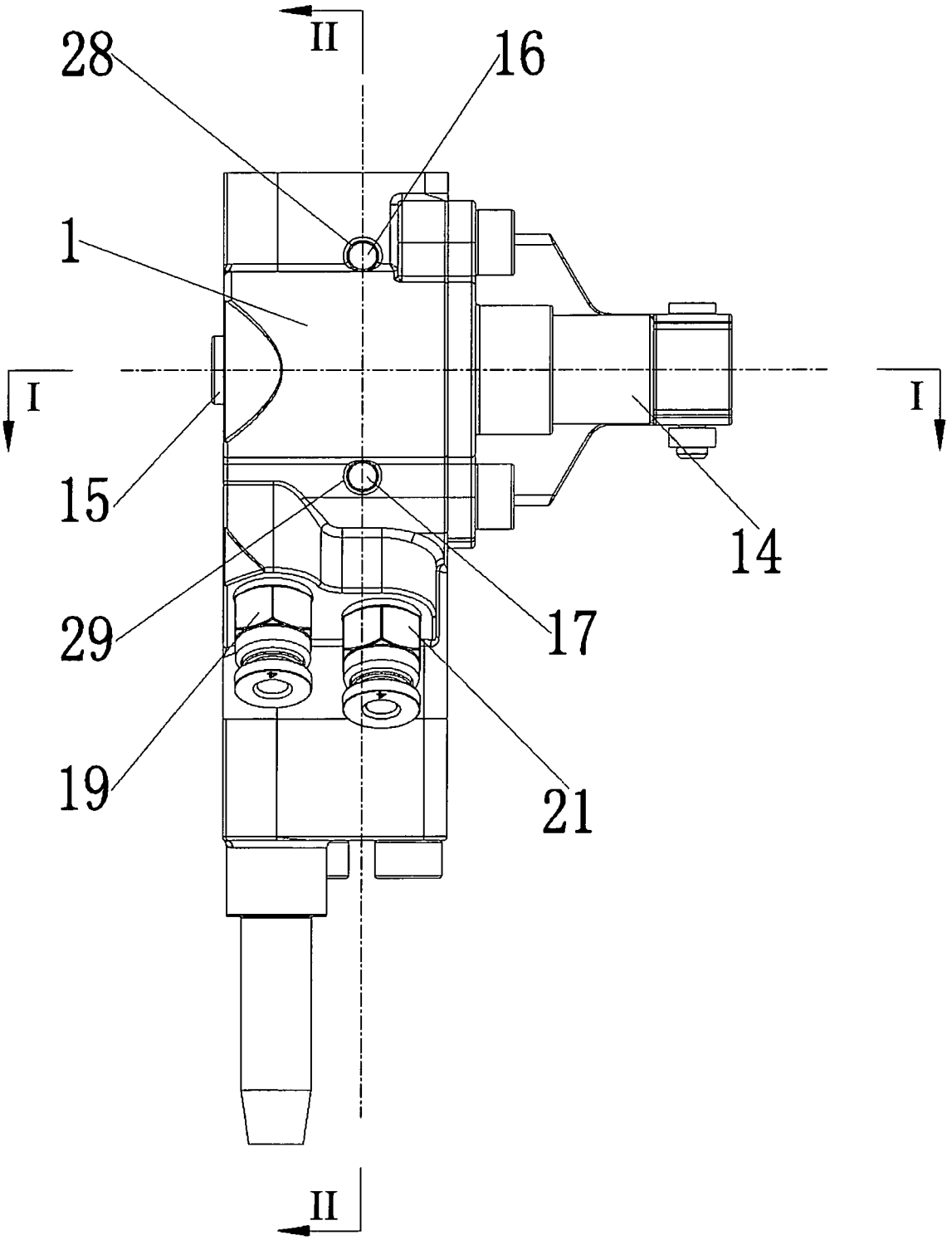
FIG. 3 is a side view of the nail supply device for pneumatic nail gun of the present invention.
Figure 4:
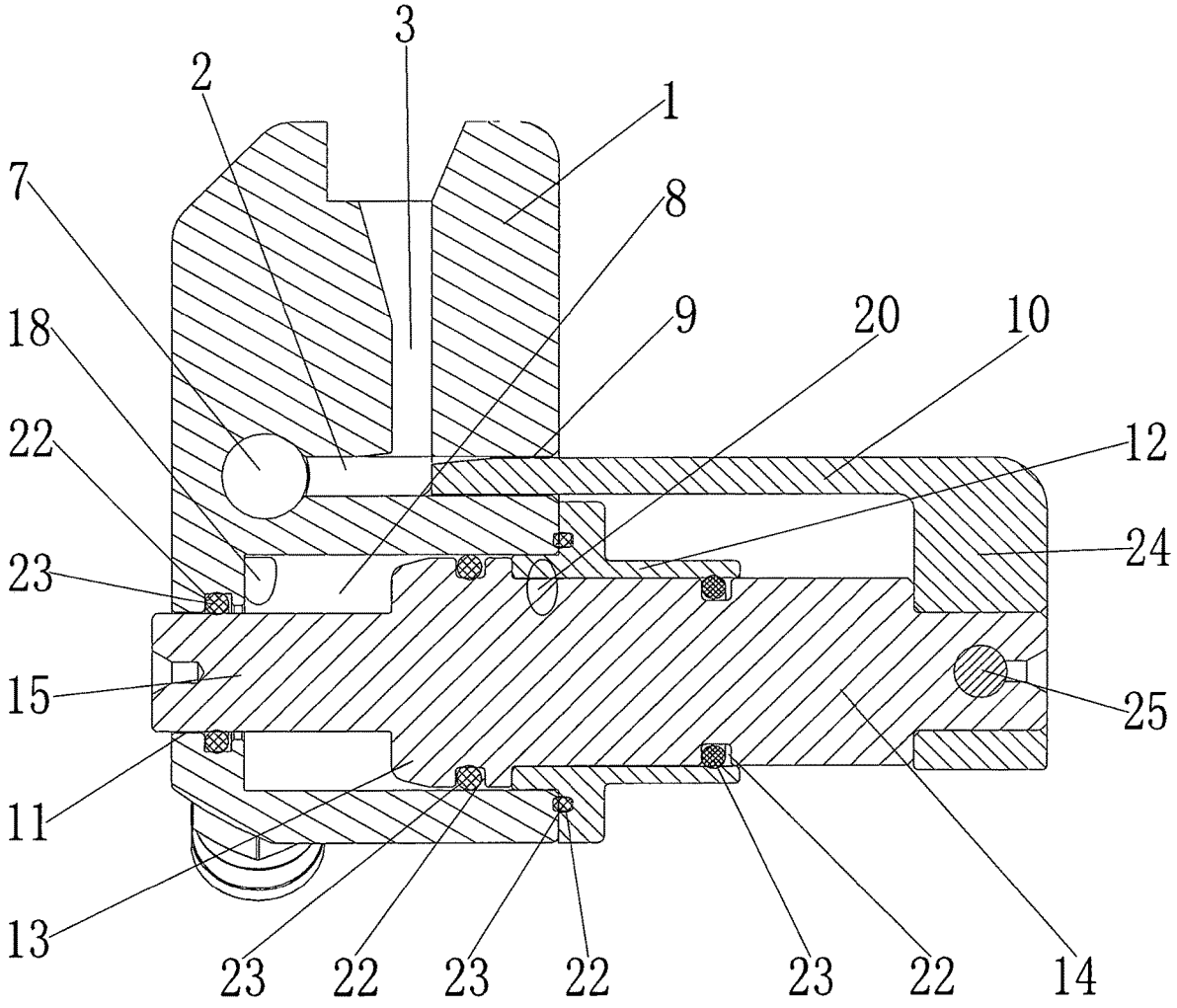
FIG. 4 is a I-I sectional view of FIG. 3.
Figure 5:
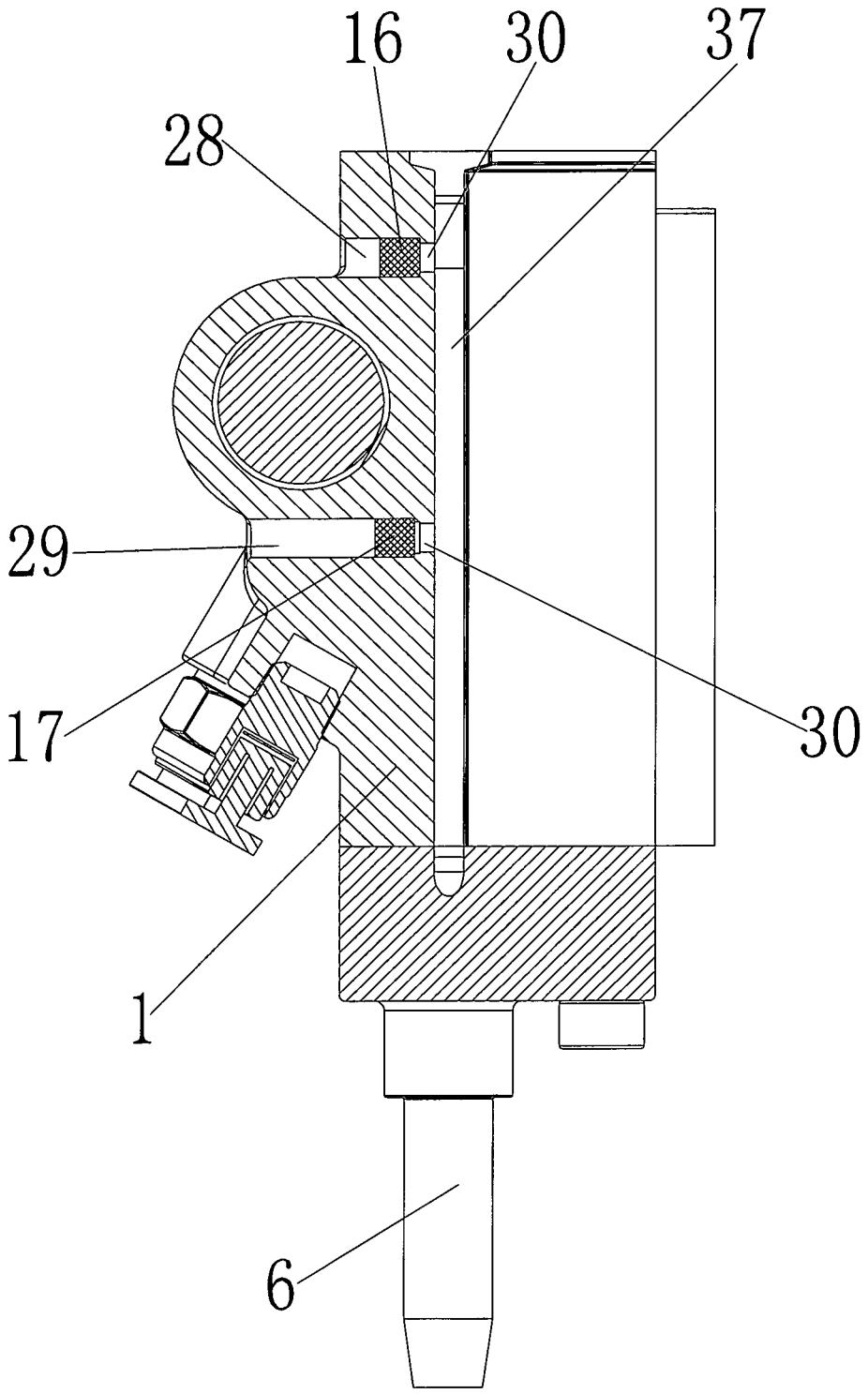
FIG. 5 is a II-II sectional view of FIG. 3.
Figure 6:
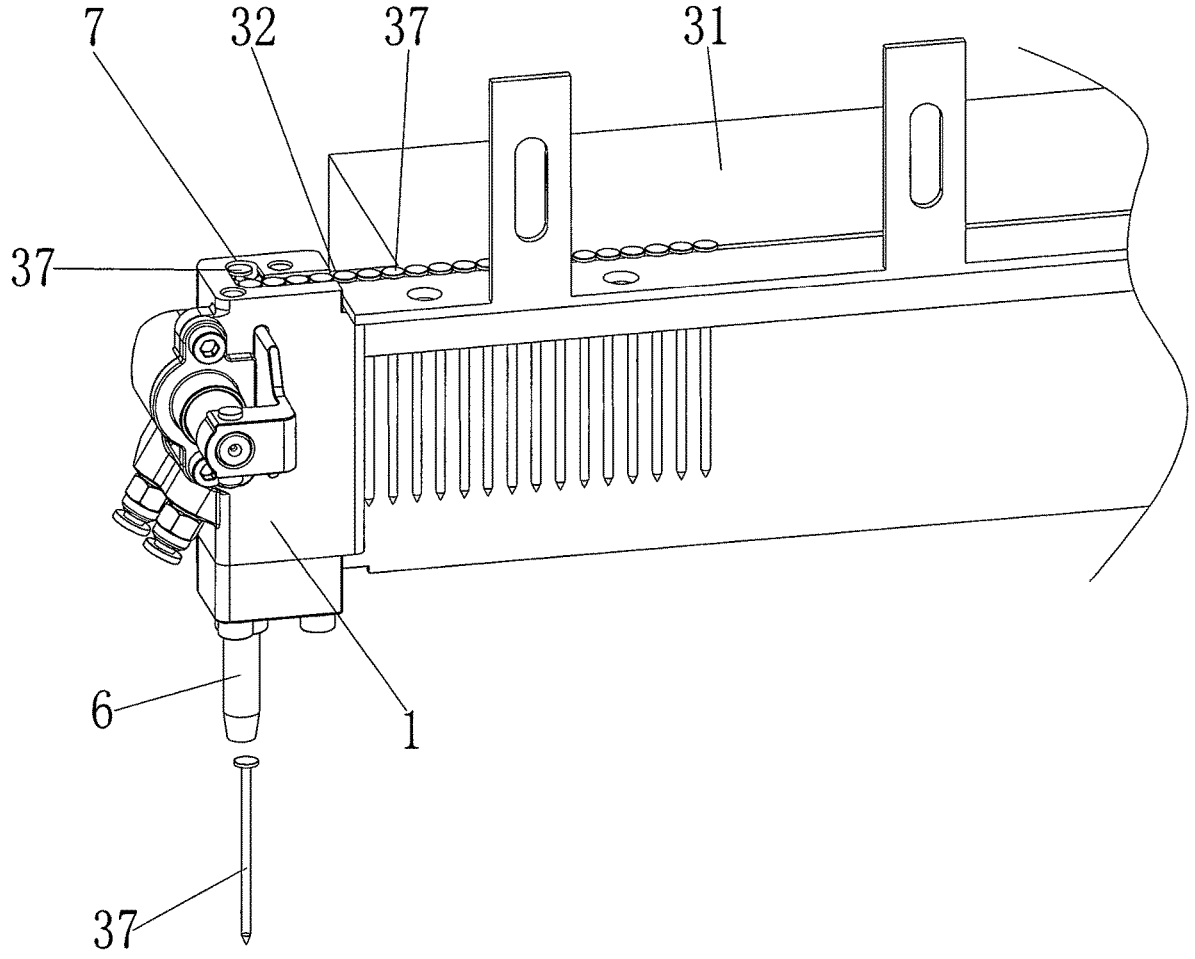
FIG. 6 is a structural representation of the nail supply device for pneumatic nail gun of the present invention connected to the vibrating tray.
Figure 7:
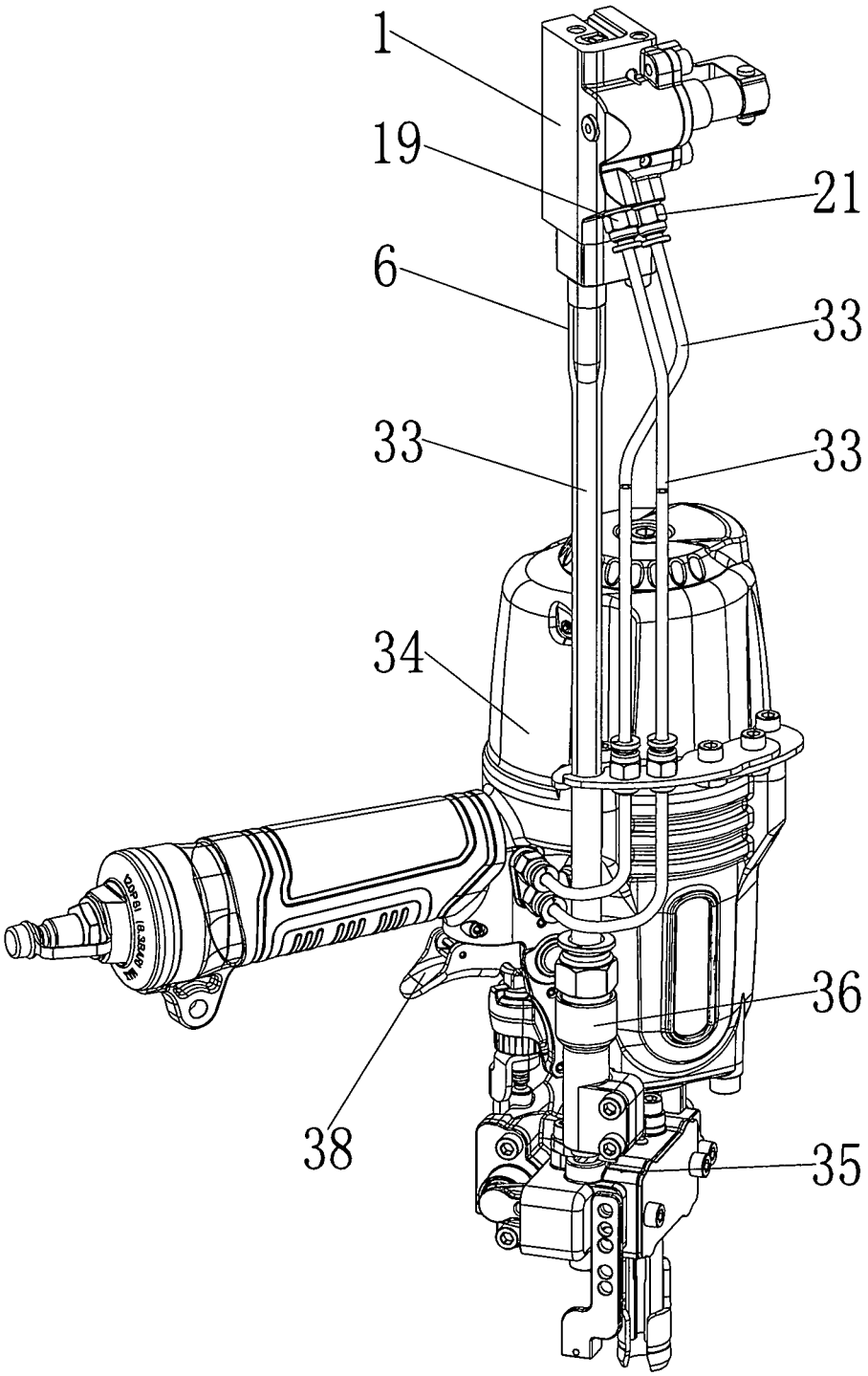
FIG. 7 is a structural representation of the nail supply device for pneumatic nail gun of the present invention connected to the pneumatic nail gun.

FIG. 1 to FIG. 7 disclose a nail supply device for pneumatic nail gun, which comprises a piston seat 1, the upper surface of the piston seat 1 is provided with a longitudinal slideway 2; the right sidewall of the piston seat 1 is provided with a transverse slideway 3 connected to longitudinal slideway 2; both sides of inner walls of the longitudinal slideway 2 and transverse slideway 3 are provided with nail guide plates 4, the opposite nail guide plates 4 are arranged in funnel shape, there is a slide clearance 5 between the opposite nail guide plates 4; the lower surface of the piston seat 1 is provided with a nail output interface 6; the upper surface of the piston seat 1 is provided with a nail inlet hole 7 vertically connected to the nail output interface 6, the front side of nail inlet hole 7 is connected to the rear side of longitudinal slideway 2; the front sidewall of the piston seat 1 is provided with a piston hole 8 and a nail push hole 9 adjacent to piston hole 8, the nail push hole 9 is connected to the longitudinal slideway 2; a matched nail push block 10 is located in the nail push hole 9; the nail push block 10 is opposite to the slide clearance 5 in the longitudinal slideway 2, the width of nail push block 10 is smaller than the width of slide clearance 5; the rear sidewall of the piston seat 1 is provided with a spacing hole 11 connected to piston hole 8; the front orifice of the piston hole 8 is provided with a piston cover 12; a matched piston 13 is located in the piston hole 8; the front end of the piston 13 is provided with a front piston rod 14 matching the piston cover 12, the back end of piston 13 is provided with a back piston rod 15 matching the spacing hole 11; the front piston rod 14 is extended through the piston cover 12 and connected to the nail push block 10; the upper and lower parts of the inner wall on the left of the junction of the longitudinal slideway 2 and transverse slideway 3 are provided with an upper magnet 16 and a lower magnet 17 respectively; the forward-backward reciprocating action of the piston 13 is implemented by the first air delivery device and the second air delivery device.

The first airflow device has a first air passage 18 located in piston seat 1; one end port of the first air passage 18 is located in the back end inner wall of piston hole 8, the other end port is connected to a first air passage interface 19; the second airflow device has a second air passage 20 located in piston seat 1; one end port of the second air passage 20 is located in the front end inner wall of piston hole 8, the other end port is connected to a second air passage interface 21; the piston 13 is located between the port of the first air passage 18 in the inner wall of piston hole 8 and the port of the second air passage 20 in the inner wall of piston hole 8.

The inner wall of the spacing hole 11, the outer wall of piston 13, the outer wall of front piston rod 14 and one sidewall of piston cover 12 opposite to the right orifice of piston hole 8 are provided with several seal grooves 22; there are matched seal rings 23 located in the seal grooves 22.

An orthogonal link block 24 extends from the end of the nail push block 10; the link block 24 is connected to the end of front piston rod 14 by an axle pin 25.

The upper surface of the piston seat 1 is provided with several fixing screw holes 26.

A chucking step 27 is located on the right side of upper end of the piston seat 1.

The left sidewall of the piston seat 1 is provided with an upper mounting slot 28 and a lower mounting slot 29 located normally under the upper mounting slot 28, the upper magnet 16 is installed in the upper mounting slot 28, the lower magnet 17 is installed in the lower mounting slot 29. The upper mounting slot 28 and lower mounting slot 29 are connected to the longitudinal slideway 2 by a clearance hole 30.

The usage of the present invention is described below:

Before the nail supply device of the present invention is used, the nail supply device is installed on the vibrating tray 31, the screws can be driven into the fixing screw holes 26 of piston seat 1 to fix the nail supply device to the vibrating tray 31. In the installation process, the nail outlet 32 of vibrating tray 31 can be inserted in the right notch of transverse slideway 3 for feeding nails. The chucking step 27 can complete the connection between piston seat 1 and vibrating tray 31 quickly, implementing fast assembly of piston seat 1 and vibrating tray 31. After the assembly is done, the connection between pneumatic nail gun 34 and nail output interface 6 and the connection between the first air passage interface 19 and the second air passage interface 21 can be completed by a hose 33. The nail output interface 6 is connected to the nail loading inlet 36 of the charger 35 of pneumatic nail gun 34, and the first air passage interface 19 and the second air passage interface 21 are connected to the air passage system of pneumatic nail gun 34. The first air passage interface 19 is always aerated.

A plurality of nails are placed in the vibrating tray 31, as the vibrating tray 31 is actuated, the vibrating tray 31 generates vibrational force automatically to convey the unorderly nails in the vibrating tray 31 towards the nail outlet 32, and the nails are arranged regularly in the transport process, each nail 37 is closely next to another one, and the nail head is on nail body. When a nail 37 is conveyed by the vibrating tray to the nail outlet, it is pushed by the next nail 37 into the right notch of transverse slideway of nail supply device, the head of the nail 37 in the transverse slideway is stuck above the nail guide plates 4 on both sides, and the body of nail 37 is in the slide clearance 5 between the nail guide plates. As the vibrating tray 31 conveys nails 37 continuously, there are more and more nails 37 in the transverse slideway 3. The former nail 37 in the transverse slideway 3 will be pushed by the latter nail to approach the junction of transverse slideway 3 and longitudinal slideway 2 continuously.

When the first nail 37 moves to a position, the upper magnet 16 and lower magnet 17 attract the first nail 37 directly. When the pneumatic nail gun uses air pressure for nailing, under the effect of the air passage system of pneumatic nail gun, some air is delivered to the second air passage interface 21 through the hose, and the second air passage interface 21 delivers the air to the front end of piston hole 8 through the second air passage 20. At this point, the front air pressure of piston hole 8 with the port of the second air passage 20 is higher than the rear air pressure of piston hole 8 with the port of the first air passage 18. Under the effect of air pressure difference, the piston 13 moves from the front to the back directly, as the piston 13 moves, the front piston rod 14 is retracted into the piston hole 8. The end of front piston rod 14 is connected to the nail push block 10, the front piston rod 14 drives the nail push block 10 into the nail push hole 9, extending into the longitudinal slideway 2. As the nail push block 10 enters the longitudinal slideway 2, the nail attracted by the upper magnet 16 and lower magnet 17 is pushed in the longitudinal slideway 2 directly, moving towards the nail inlet hole 7. When the nail is pushed by the nail push block 10 to the nail inlet hole 7, the nail 37 drops vertically through the nail inlet hole 7, and enters the hose 33 through the nail output interface 6. Finally, the nail is moved to the nail loading inlet 36 of charger 35 of pneumatic nail gun 34 under the gravity. In the nailing process of pneumatic nail gun 34, the nails are loaded automatically, manual loading is unnecessary even if the nails are used up. The pneumatic nail gun 34 is operated under the vibrating tray 31, and the hose can remain relatively upright, as one nail is dropped at a time, the hose 33 will not be blocked by nails.

When a nailer has finished a nailing job, the switch 38 of pneumatic nail gun 34 is released, and then the air passage system of pneumatic nail gun 34 stops delivering air to the second air passage 20, the rear air pressure of piston hole 8 is higher than the front air pressure of piston hole 8 again. Under the effect of the air pressure difference, the piston 13 is resetted, the front piston rod 14 drives the nail push block 10 to reset, and the nail in the front end of transverse slideway 3 is attracted by the upper magnet 16 and lower magnet 17 again, a cycle is formed, when the nailer uses pneumatic nail gun 34 for nailing, the nails in the vibrating tray 31 are fed into the pneumatic nail gun 34 by the nail supply device continuously.

To sum up, the present invention can receive the nails 37 from the vibrating tray 31 continuously, it supplies nails to the pneumatic nail gun 34 in each operation, so that the charger 35 of pneumatic nail gun 34 always has sufficient nails, the manual loading process is omitted, the workload is reduced and the nailing efficiency is increased effectively, and the nailer can concentrate on nailing, the nailing quality is guaranteed effectively.

The inner wall of spacing hole 11, the outer wall of piston 13, the outer wall of front piston rod 14 and one sidewall of piston cover 12 opposite to the right orifice of piston hole 8 are provided with several seal grooves 22, the matched seal rings 23 are located in the seal grooves 22. The seal rings 23 can enhance the sealing performance of components effectively to avoid air leak, so that the piston 13 can perform the forward-backward reciprocating motion stably and quickly, and the nail supply quality is guaranteed.

An orthogonal link block 24 extends from the end of nail push block 10, the link block 24 is connected to the end of front piston rod 14 by axle pin 25, this connection mode is favorable for the assembly and disassembly of nail push block 10 and front piston rod 14. When the piston 13 or nail push block 10 is damaged, only one component shall be changed, the maintenance cost is saved effectively.

The left sidewall of piston seat 1 is provided with an upper mounting slot 28 and a lower mounting slot 29 located normally under the upper mounting slot 28. The upper magnet 16 is installed in the upper mounting slot 28, and the lower magnet 17 is installed in the lower mounting slot 29. The upper magnet 16 and lower magnet 17 only attract the upper and lower points of nail 37, so as to avoid excessive magnetic force of excessive adsorption area attracting back the nail which has been pushed to the nail inlet hole 7, and the upper mounting slot 28 and lower mounting slot 29 are connected to the longitudinal slideway 2 by the clearance hole 30. The clearance hole 30 can avoid the nail 37 being tightly adsorbed by the upper magnet 16 and lower magnet 17, the degree of adsorption of nail 37 is reduced to enhance the smoothness when the nail push block 10 pushes nail 37.

We claim:

1. A nail supply device for pneumatic nail gun, comprising:

a piston seat comprising:

an upper surface provided with a longitudinal slideway;

a right sidewall provided with a transverse slideway connected to the longitudinal slideway at a junction;

wherein the longitudinal and transverse slideways comprise inner walls on opposing sides of the slideways, wherein the inner walls are provided with nail guide plates, wherein the opposing nail guide plates are arranged in a manner forming a funnel shape, wherein a slide clearance is formed between the opposing nail guide plates;

a lower surface of provided with a nail output interface;

wherein the upper surface is provided with a nail inlet hole vertically connected to the nail output interface, a front side of nail inlet hole is connected to a rear side of longitudinal slideway;

a front sidewall of the piston seat is provided with a piston hole and a nail push hole adjacent to the piston hole, wherein the nail push hole is connected to the longitudinal slideway;

a front orifice of the piston hole;

a rear sidewall provided with a spacing hole connected to the piston hole;

an upper magnet provided on an upper part of an inner wall at the junction of the slideways; and a lower magnet provided on a lower part of the inner wall at the junction of the slideways;

a nail push block located in the nail push hole; wherein the nail push block comprises a shape which matches a shape of the nail push hole, wherein the nail push block is configured to extend into the longitudinal slideway, wherein a width of nail push block is smaller than a width of the slide clearance;

a piston cover provided at the front orifice of the piston hole;

a piston located in the piston hole, wherein the piston comprises a shape which matches a shape of the piston hole, wherein the piston further comprises;

a front end provided with a front piston rod, wherein the front piston rod comprises a shape which matches a shape of an opening of the piston cover such that the front piston rod extends through the piston cover, and wherein the front piston rod is connected to the nail push block;

a back end provided with a back piston rod, wherein the back piston rod comprises a shape which matches a shape of the spacing hole; and a first air delivery device and a second air delivery device, wherein the air delivery devices implement a forward-backward reciprocating action of the piston.

2. The nail supply device for pneumatic nail gun defined in claim 1, wherein the first air delivery device has a first air passage located in the piston seat; one end port of the first air passage is located in a back end inner wall of the piston hole, the other end port is connected to a first air passage interface; the second air delivery device has a second air passage located in the piston seat; one end port of the second air passage is located in a front end inner wall of the piston hole, the other end port is connected to a second air passage interface; the piston is located between the port of the first air passage in the inner wall of the piston hole and the port of the second air passage in the inner wall of the piston hole.

3. The nail supply device for pneumatic nail gun defined in claim 1, wherein an inner wall of the spacing hole, the an outer wall of piston, an outer wall of the front piston rod and one sidewall of the piston cover opposite to a right orifice of the piston hole are provided with a plurality of seal grooves; wherein the seal grooves include a plurality of seal rings.

4. The nail supply device for pneumatic nail gun defined in claim 1, wherein an end of the nail push block includes an orthogonal link block extended therefrom; the link block is connected to an end of the front piston rod by an axle pin.

5. The device defined in claim 1, wherein the upper surface of the piston seat is provided with a plurality of fixing screw holes.

6. The nail supply device for pneumatic nail gun defined in claim 1, wherein the piston seat includes a chucking step disposed on a right side of an upper end thereof.

7. The nail supply device for pneumatic nail gun defined in claim 1, wherein the piston seat includes an upper mounting slot disposed on a left sidewall thereof and a lower mounting slot disposed under the upper mounting slot;

wherein the upper magnet is installed in the upper mounting slot, and the lower magnet is installed in the lower mounting slot;

the upper mounting slot is connected to the longitudinal slideway through a first clearance hole; the lower mounting slot is connected to the longitudinal slideway through a second clearance hole.

* * * * *